US007943211B2

(12) United States Patent
Chen

(10) Patent No.: US 7,943,211 B2
(45) Date of Patent: May 17, 2011

(54) THREE DIMENSIONAL DISPLAYS HAVING DEFORMABLE CONSTRUCTIONS

(75) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 0 days.

(21) Appl. No.: 11/999,824

(22) Filed: Dec. 6, 2007

(65) Prior Publication Data

US 2010/0003891 A1 Jan. 7, 2010

(51) Int. Cl.
*F21S 6/00* (2006.01)
*A47G 33/06* (2006.01)
*B44F 1/00* (2006.01)

(52) U.S. Cl. ..... 428/9; 428/8; 428/12; 428/20; 362/249.16; 362/97.1; 362/458; 362/121; 362/122; 362/123; 362/124; 362/806; 362/808; 362/809; 446/387; 446/388

(58) Field of Classification Search ..... 428/7, 8, 428/9, 12, 20; 362/565–568, 97.1, 122, 123, 362/458, 806–809
See application file for complete search history.

(56) References Cited

U.S. PATENT DOCUMENTS

| | | | | |
|---|---|---|---|---|
| 1,314,008 | A | | 8/1919 | McWilliams |
| 1,536,332 | A | | 5/1925 | Dam |
| 2,050,364 | A | | 8/1936 | Morton |
| 2,072,337 | A | | 3/1937 | Kamm |
| 2,484,596 | A | | 10/1949 | Waltz |
| 2,984,813 | A | | 5/1961 | Bossi |
| 3,286,088 | A | | 11/1966 | Ahroni |
| 3,345,482 | A | | 10/1967 | Lou |
| 3,522,579 | A | | 8/1970 | Matsuya |
| 3,677,867 | A | * | 7/1972 | Westlund ..... 428/9 |
| 3,747,124 | A | * | 7/1973 | Zientara ..... 2/202 |
| 3,783,437 | A | | 1/1974 | Graff et al. |
| 4,340,841 | A | | 7/1982 | Schupp |
| 4,546,041 | A | | 10/1985 | Keane et al. |
| 4,720,272 | A | | 1/1988 | Durand |
| 4,727,449 | A | | 2/1988 | Fleck |
| 4,769,579 | A | | 9/1988 | Jou |
| 4,808,885 | A | | 2/1989 | Bauch et al. |
| 4,847,123 | A | | 7/1989 | Armstead et al. |
| 4,870,547 | A | | 9/1989 | Crucefix |
| 4,894,019 | A | | 1/1990 | Howard |
| 5,071,362 | A | | 12/1991 | Martens et al. |
| 5,139,343 | A | | 8/1992 | Lin |
| 5,281,158 | A | | 1/1994 | Lin |

(Continued)

OTHER PUBLICATIONS

US International Search Report and Written Opinion for PCT/US06/21242 dated Oct. 4, 2006.

(Continued)

*Primary Examiner* — Aaron Austin
(74) *Attorney, Agent, or Firm* — Patterson Thuente Christensen Pedersen P.A.

(57) ABSTRACT

An improved three dimensional display such as a Holiday decoration having collapsible constructions having a shape memory internal frame. In one embodied form, the unique display includes a collapsible internal frame formed, in part, from metal wire imparted with suitable memory characteristics. Such metals are referred to as "shape memory alloys" (SMAs) because much metals "remember" their original shapes. Accordingly, the present invention uses a deformable internal metal frame supporting an outer sheath formed from suitable materials such as fabric, or plastic film for the skin of the inventive three dimensional displays.

24 Claims, 5 Drawing Sheets

U.S. PATENT DOCUMENTS 5,336,536 A * 8/1994 Oberzan ..... 428/8
5,379,202 A * 1/1995 Daun ..... 362/249.16
5,405,662 A * 4/1995 Oberzan ..... 428/8
5,442,258 A 8/1995 Shibata
5,443,897 A * 8/1995 Kawaguchi et al. ..... 428/300.7
5,453,664 A 9/1995 Harris
5,456,620 A 10/1995 Kaminski
5,607,734 A 3/1997 Gonzalez
5,702,262 A 12/1997 Brown et al.
5,707,136 A 1/1998 Byers
5,709,457 A 1/1998 Hara
5,720,544 A 2/1998 Shu
5,722,766 A 3/1998 Shu
5,727,872 A 3/1998 Liou
5,759,062 A 6/1998 Chen
5,775,933 A 7/1998 Chen
5,788,361 A 8/1998 Lee
5,791,765 A 8/1998 Lin
5,791,940 A 8/1998 Chen et al.
5,795,189 A 8/1998 Liou
5,807,134 A 9/1998 Hara
5,816,849 A 10/1998 Schmidt
5,816,862 A 10/1998 Tseng
5,828,183 A 10/1998 Wang et al.
5,829,865 A 11/1998 Ahroni
5,834,901 A 11/1998 Shen
5,839,819 A 11/1998 Pan
5,848,838 A 12/1998 Presta
5,850,927 A * 12/1998 Pan ..... 211/181.1
5,852,348 A 12/1998 Lin
5,854,541 A 12/1998 Chou
5,860,731 A 1/1999 Martinez
5,860,830 A 1/1999 Wu
6,053,774 A 4/2000 Lin
6,084,357 A 7/2000 Janning
6,113,430 A 9/2000 Wu
6,203,169 B1 3/2001 Coushaine et al.
6,257,740 B1 7/2001 Gibboney, Jr.
6,283,797 B1 9/2001 Wu
6,284,330 B1 9/2001 Hermanson
6,347,965 B1 2/2002 Pan
6,361,368 B1 3/2002 Tseng
6,533,437 B1 3/2003 Ahroni
6,541,800 B2 4/2003 Barnett et al.
6,580,182 B2 6/2003 Janning
6,592,426 B2 * 7/2003 Mesch ..... 446/310
6,595,657 B1 7/2003 Shieh
6,609,814 B2 8/2003 Ahroni
6,719,440 B1 4/2004 Wang
6,805,463 B2 10/2004 Shieh
6,830,361 B2 12/2004 Wang
6,840,655 B2 1/2005 Shen
6,905,229 B2 * 6/2005 Fan ..... 362/235
6,929,383 B1 8/2005 Janning
7,086,757 B2 8/2006 Wang
7,235,815 B2 6/2007 Wang
7,253,556 B1 8/2007 Gibboney
7,264,392 B2 9/2007 Massabki et al.
7,581,870 B2 9/2009 Massabki et al.
7,661,847 B2 * 2/2010 Wang ..... 362/249.16
7,682,060 B2 * 3/2010 Wang ..... 362/565
7,878,685 B2 * 2/2011 Wang ..... 362/249.16
2002/0118540 A1 8/2002 Ingrassia
2003/0142494 A1 7/2003 Ahroni
2003/0198044 A1 10/2003 Lee
2003/0198048 A1 10/2003 Frederick
2003/0218412 A1 11/2003 Shieh
2004/0105270 A1 6/2004 Shieh
2005/0077525 A1 4/2005 Lynch et al.
2005/0122723 A1 6/2005 Frederick
2005/0286267 A1 12/2005 Wang
2006/0146578 A1 7/2006 Kuo
2006/0274556 A1 12/2006 Massabki et al.
2007/0064414 A1 3/2007 Wang
2008/0151569 A1 6/2008 Wang
2008/0186740 A1 8/2008 Huang et al.
2008/0303446 A1 12/2008 Ding
2009/0027886 A1 1/2009 Wang
2010/0202156 A1 * 8/2010 Wang ..... 362/567

OTHER PUBLICATIONS

Supplementary European Search Report for European Application No. EP06760620 dated Jul. 11, 2008.

* cited by examiner

THREE DIMENSIONAL DISPLAYS HAVING DEFORMABLE CONSTRUCTIONS

BACKGROUND OF THE INVENTION

The present invention relates to collapsible three-dimensional displays such as Holiday decorations. In one embodied form, the unique decoration includes an internal metal frame formed, at least in part, from metal alloys imparted with suitable memory characteristics.

A portion of the disclosure of this patent document contains material, which is subject to copyright protection. The copyright owner has no objection to the facsimile reproduction by anyone of this patent document or the patent disclosure, as it appears in the U.S. Patent and Trademark Office patent file or records, but otherwise reserves all copyrights whatsoever.

Shape memory alloys (SMAs) are metals that "remember" their original shapes. SMAs are useful for a wide variety of products owing to their ability to "change shape, stiffness, position, natural frequency, and other mechanical characteristics" in response to a change in an applied force such as temperature or pressure. The potential uses for SMAs have broadened the spectrum of many applications. The diverse applications for these metals have made them increasingly important and visible to the world.

SMAs may have different kinds of shape memory effect. The two most common memory effects are the one-way and two-way shape memory.

For instance, the SMA material can return to some previously defined shape or its original size when not subjected to compression can be said to have a one-way shape effect. That is, SMA can be physically deformed at some prescribed range of exerted mechanical force and, upon release of such compressive force, the SMA material will return to its original shape.

In the art of three dimensional displays it is known to have one or more collapsible elements incorporated into the display device for ease of storage as well as a means to capture viewer interest. Among such conventional displays and devices are the following disclosures which are hereby incorporated by this reference.

Meschs in U.S. Pat. No. 6,592,426 discloses a device including a container having a releasable cover, which is biased by a compressible elastic member when the releasable cover is in a closed position. A molded rubber sheath encapsulates the compressed elastic member, and the rubber sheath provides a three dimensional figure which is collapsible in the closed position for storage in the container and which recovers to the three dimensional figures when release from the container. A release mechanism is provided in operative relationship with the releasable cover to permit the three dimensional figure to be released by the compressible elastic member when triggered by the release mechanism.

U.S. Pat. No. 6,284,330 B1 to Hermanson discloses an expandable three-dimensional display device is provided with a cover and a support post at least partially disposed within the cover. The sliding member slidably moves along the support post such that the plurality of extension members can be extended generally radially away from the support post or retracted to collapse, and lie along and be generally parallel to the support post. A cover is supported by the extension members and is expanded and collapsed as the extension members extend and retract. This mechanism may be similar to a conventional umbrella. The cover may be configured to represent an easily recognized holiday figure such as, for example, Santa Claus, the Easter Bunny or a snow man.

Additionally, a light may be supported by the support post to illuminate the cover from within and render it visible after dark. The display device includes a mechanism associated with the cover and support post that is operable alternately to expand the cover to an enlarged configuration about the post to provide a three-dimensional display and collapse the covers to a collapsed configuration. A light is mounted within the cover to illuminate it. A portion of the display structure is formed to be mounted on the upper end of the support post which projects through the cover and additionally to be secured to the cover in order to provide the assembled display with further texture and interest.

Armstead in U.S. Pat. No. 4,847,123 discloses a pop-up artificial Christmas tree having an elongated trunk which is held vertical by a stand. The pop-up Christmas tree may be collapsed to a storage state when the guide sleeve is slid away from the lower-most stationary sleeve, the extension taken from the top, and the collapsed tree and extension taken from the top, and the collapsed tree and extension may be stored in a bag that also serves as an under-the-tree spread. From the storage stage, the pop-up artificial Christmas tree may be popped up again to the posture of a natural tree like one might pop up an umbrella.

U.S. Pat. No. 7,086,757 B2 to Wang discloses a formed lighting fixture having a frame, a plurality of bulbs, and a refracting layer, in which the frame is formed by gathering a plurality of rods and profiled in a specific contour, the bulbs are installed on the frame to serve as lighting ornaments, and the rod frame is coated with a refracting layer of a transparent material. A formed lighting fixture so constructed can offer a dazzling effect to thereby reduce bulb amount and facilitate production.

Gonzalez in U.S. Pat. No. 5,607,734 discloses an expansible ornament assembly comprising an expansible form having an open position and a closed position and constructed of a lightweight material such as tissue paper. When in the open position, the expansible ornament assembly is adapted to display a three dimensional object or another simulative representation such as a letter, phrase, or the like. The ornament assembly may be used in combination with a gift wrapping sheet which coordinates in some respect with the displayed three dimensional object.

While recognizing the desirability of collapsible design features in three dimensional displays and devices, these conventional structures have required relatively complex mechanisms to achieve such goal. Moreover, many of these structures provide only limited compactness when such display is stored and not in use.

Accordingly, those skilled in the art have recognized a significant need for collapsible three dimensional displays such as Seasonal Holiday decorations which may be conveniently reduced to a compact shape for shipment and storage without complicated construction. The present invention fulfills these needs.

These and other objects, features and advantages of the present invention will become apparent from the following detailed description of illustrative embodiments thereof, which is to be read in connection with the accompanying drawings.

SUMMARY OF THE INVENTION

Improved three dimensional displays such as seasonal Holiday decorations are provided. In one embodied form, the unique display constructions include a collapsible internal support frame imparted with suitable memory characteristics. The internal frame comprises "shape memory alloys" which "remember" their original shapes after deformation. Accordingly, the embodied displays of the present invention utilize a deformable frame as a spine that may be surmounted with suitable outer coverings such as elastic fabric or plastic film for the skin of the three dimensional display. The inventive display may include other decorative features such as interior lighting, sound and visual effects.

The support frame may be fabricated, at least in part, from from shape memory alloy material that can return to its originally defined shape when not subjected to a prescribed range of compressive force. The outer covering preferably is flexible and elastic to provide a complementary form fit with the internal support frame of the display. A releasable retaining element such as a clip or clasp member may be used to maintain the support frame in a deformed condition for shipping and storage of the display, but upon release will permit the frame to return to its original full size and three dimensional configuration.

In other embodiments, the display may include a vibration device coupled to the amusement device to produce vibrational motion of the three dimensional figure. The sheath may be clear, translucent or opaque and provide a paintable surface. The sheath may include means for attaching other display components such as three-dimensional molded details, body features, personal effects and appendages. The three dimensional display outer covering may include a molded image of one of a human, an animal, a fictional character, a cartoon character, a comic character, or inanimate object such as Christmas Tree or ornament. The display may include rigid parts attached to the flexible sheath and/or other collapsible elements and features connected to the outer sheath. The sheath may include wind slots, air holes and the like to provide for stability of the display during varying weather conditions and to provide ease in the deforming process when the display is to be stored and not in use.

These and other objects, features and advantages of the present invention will become apparent from the following detailed description of illustrative embodiments thereof, which is to be read in connection with the accompanying drawings.

DESCRIPTION OF THE PREFERRED EMBODIMENTS

Figure 1:
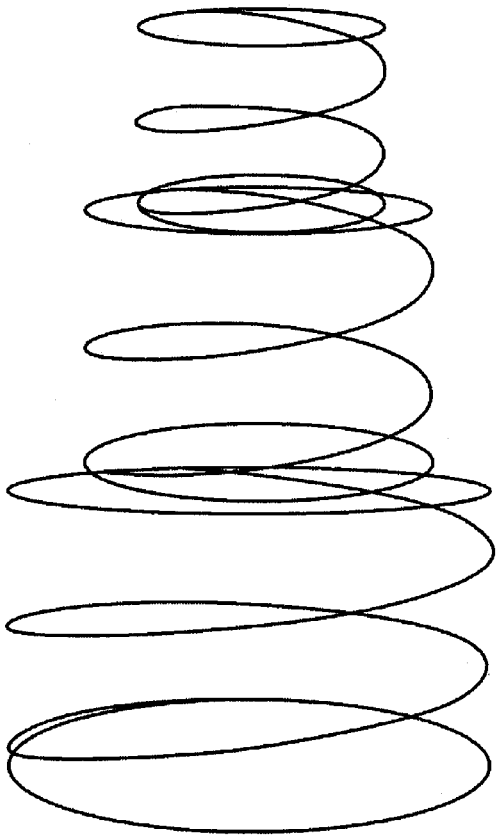
FIG. 1 is a front perspective view of one embodied form of the present invention illustrating the deformable internal frame having a generally spiral configuration.

The present invention provides improved three dimensional displays such as sculptures and seasonal decorations having a collapsible frame construction fabricated in total, or in pertinent part, from shape memory alloys ("SMA wire"). In one embodied form, a deformable metal frame having suitable shape memory characteristics is used as a spine and covered with a flexible outer skin of elastic web. The elastic web may be of knitted or woven fabric, or may be formed whole, or in part, from plastic films. The display may include other conventional features such as internal lighting, sound, motion and other visual effects.

In one embodied form, the invention provides three dimensional collapsible display construction comprising: a deformable internal frame fabricated from a material that can return to its originally defined shape when not subjected to a compressive force within a prescribed range; an outer elastic sheath surmounting said deformable internal frame member, the sheath and frame providing a display which is collapsible in the closed position for storage and which recovers to its original full size and three dimensional display configuration when not subjected to said prescribed compressive force; and a releasable retaining element for maintaining said deformable internal frame in a deformed condition when the element is in a closed position.

Accordingly, the embodied displays of the present invention utilize a deformable frame as a spine that may be surmounted with suitable outer coverings such as elastic fabric or plastic film for the skin of the three dimensional display. The inventive display may include other decorative features such as interior lighting, sound and visual effects.

The support frame may be fabricated, at least in part, from from shape memory alloy material that can return to its originally defined shape when not subjected to a prescribed range of compressive force. The outer covering preferably is flexible and elastic to provide a complementary form fit with the internal support frame of the display. A releasable retaining element such as a clip or clasp member may be used to maintain the support frame in a deformed condition for shipping and storage of the display, but upon release will permit the frame to return to its original full size and three dimensional configuration.

In other embodiments, the display may include a vibration device coupled to the amusement device to produce vibrational motion of the three dimensional figure. The sheath may be clear, translucent or opaque and provide a paintable surface. The sheath may include means for attaching other display components such as three-dimensional molded details, body features, personal effects and appendages. The three dimensional display outer covering may include a molded image of one of a human, an animal, a fictional character, a cartoon character, a comic character, or inanimate object such as Christmas Tree or ornament. The display may include rigid parts attached to the flexible sheath and/or other collapsible elements and features connected to the outer sheath. The sheath may include wind slots, air holes and the like to provide for stability of the display during varying weather conditions and to provide ease in the deforming process when the display is to be stored and not in use.

The exterior sheath may be formed from films, fabrics or webs fabricated from plastic, nylon or any other flexible, yet durable material. The sheath is preferably translucent so that it can be illuminated from within, as is known in the art.

In more detail, the internal frame may be formed from a material that changes its shape in response to an external force and returns to its original shape when the force is removed. The energy expended in deforming the frame is stored in it and can be recovered when the internal frame returns to its original shape. Generally, the amount of the shape change is directly related to the amount of force exerted. If too large a force is applied, however, the frame will permanently deform and not return to its original shape.

There are several types of configurations that are suitable for the deformed internal frame. One suitable frame is formed by wire wound into a cylindrical or conical shape. The SMA is coiled with space between successive coils; when a deforming force is applied the coils are pushed closer together. A third type of frame configuration is designed so the applied force twists the coil into a tighter spiral. Common examples of SMAs are found in clipboards and butterfly hair clips.

Other configuration examples for components of the internal frame are shapes like a shallow arch; open-core cylinders of solid, elastic material.

As previously described the SMA may be fabricated from a wide variety of metal alloys having suitable memory characteristics. One example is memory wire formed by stretching (at room temperature) and subsequently heat treated and shaped (at a range of 280-350 degrees C.) and then cooled to ambient temperature. Memory wire is composed of the following iron alloy:

| | |
|---|---|
| Carbon (C) | 0.59% by weight |
| Silicon (Si) | 0.23% by weight |
| Manganese (Mn) | 0.62% by weight |
| Phosphorous (P) | 0.019% by weight |
| Sulfur (S) | 0.004% by weight |
| Nickle (Ni) | 0.01% by weight |
| Chromium (Cr) | 0.021% by weight |
| Copper (Cu) | 0.01% by weight |

Ferrous alloys are the most commonly used SMA materials. The most popular alloys include high-carbon wire, oil tempered low-carbon, chrome silicon, chrome vanadium, and stainless steel.

Other metals that are sometimes used to make SMAs are beryllium copper allow, phosphor bronze, and titanium. Rubber or urethane may be used for cylindrical, non-coil SMAs. Ceramic material has been developed for coiled SMAs in very high-temperature environments. One-directional glass fiber composite materials are being tested for possible use in SMA.

The deformable frame components may be formed utilizing the following processing techniques:

Coiling

Cold winding. Wire up to 0.75 inch (18 mm) in diameter can be coiled at room temperature using one of two basic techniques. One consists of winding the wire around a shaft called an arbor or mandrel. This may be done on a dedicated SMA-winding machine, a lathe, an electric hand drill with the mandrel secured in the chuck, or a winding machine operated by hand cranking. A guiding mechanism, such as the lead screw on a lathe, must be used to align the wire into the desired pitch (distance between successive coils) as it wraps around the mandrel.

Alternatively, the wire may be coiled without a mandrel. This is generally done with a central navigation computer (CNC) machine.

For extension or torsion SMA, the ends are bent into the desired loops, hooks, or straight sections after the coiling operation is completed.

Hot winding. Thicker wire or bar stock can be coiled into springs if the metal is heated to make it flexible. Standard industrial coiling machines can handle steel bar up to 3 inches (77 mm) in diameter, and custom SMAs have reportedly been made from bars as much as 6 inches (150 mm) thick. The steel is coiled around a mandrel while red hot. Then it is immediately removed from the coiling machine and plunged into oil to cool it quickly and harden it. At this stage, the steel is too brittle to function as a SMA, and it must subsequently be tempered.

Heat treating. Whether the steel has been coiled hot or cold, the process has created stress within the material. To relieve this stress and allow the SMA to maintain its characteristic resilience, the SMA must be tempered by heat treating it. The SMA is heated in an even, held at the appropriate temperature for a predetermined time, and then allowed to cool slowly. For example, a SMA made of music wire is heated to 500 degrees F. (260 degrees C.) for one hour.

Grinding. If the design calls for flat ends on the deformable frame, the ends are ground at this stage of the manufacturing process. The frame is mounted in a jig to ensure the correct orientation during grinding, and it is held against a rotating abrasive wheel until the desired degree of flatness is obtain. When highly automated equipment is used, the frame is held in a sleeve while both ends are ground simultaneously, first be coarse wheels and then by finer wheels. An appropriate fluid (water or an oil-based substance) may be used to cool the frame, lubricate the grinding wheel, and carry away particles during the grinding.

Shot peening. This process strengthens the steel to resist metal fatigue and cracking during its lifetime of repeated flexings. The entire surface of the SMA is exposed to a barrage of tiny steel balls that hammer it smooth and compress the steel that lies just below the surface.

Setting. To permanently fix the desired length and pitch of the SMA, it is fully compressed so that all coils touch each other. Some manufacturers repeat this process several times.

Coating. To prevent corrosion, the entire surface of the SMA is protected by painting it, dipping it in liquid rubber, or plating it with another metal such as zinc or chromium. One process, called mechanical plating, involves tumbling the SMA in a container with metallic powder, water, accelerant chemicals, and ting glass beads that pound the metallic powder onto the SMA surface.

Figure 2:
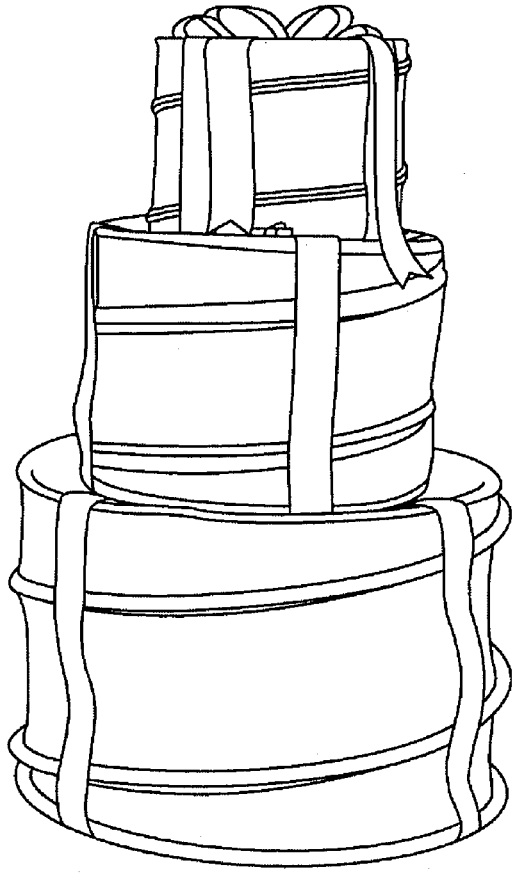
FIG. 2 is a perspective view of a display incorporating the deformable frame as shown in FIG. 1 and further illustrating the display having an exterior sheath surmounting the deformable frame.
Figure 3:
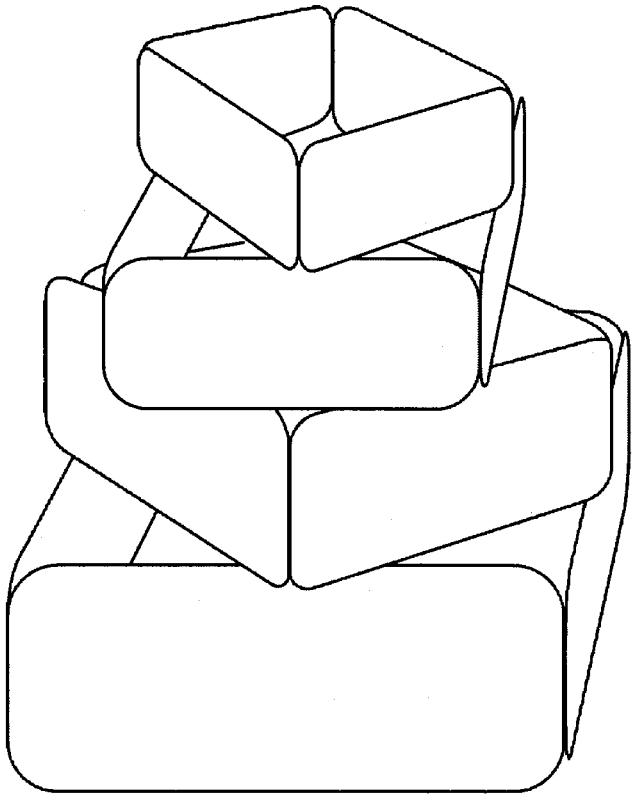
FIG. 3 is a front perspective view of one embodied form of the present invention illustrating the deformable internal frame having a generally rectangular shape.
Figure 4:
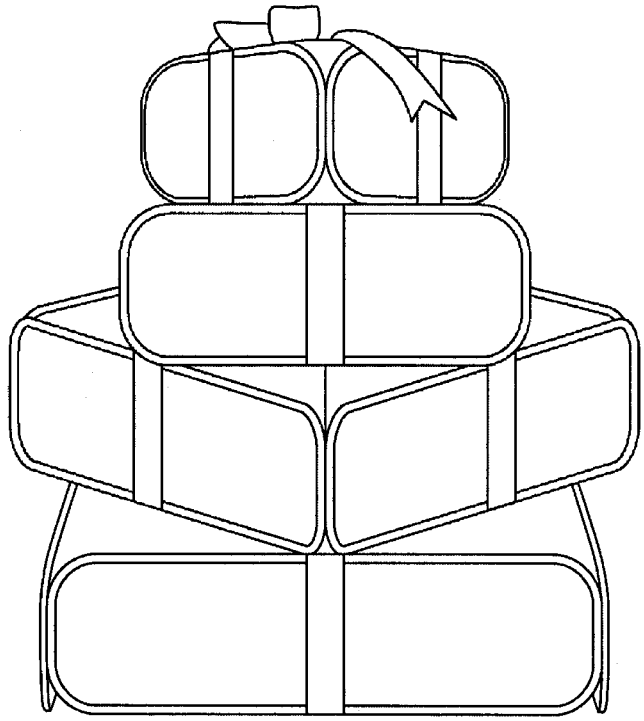
FIG. 4 is a perspective view of a display incorporating the deformable frame as shown in FIG. 3 and further illustrating the display having an exterior sheath surmounting the deformable frame.
Figure 5:
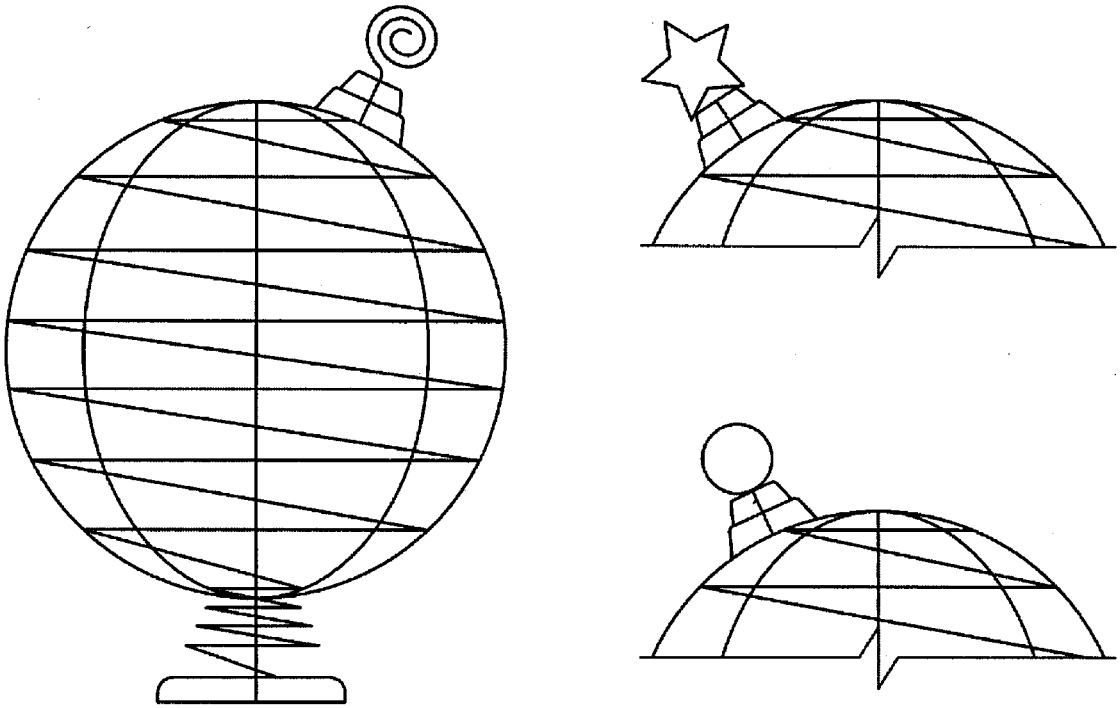
FIG. 5 is a front perspective view of one embodied form of the present invention illustrating the deformable internal frame having a generally combination of spiral and circular configurations.
Figure 6:
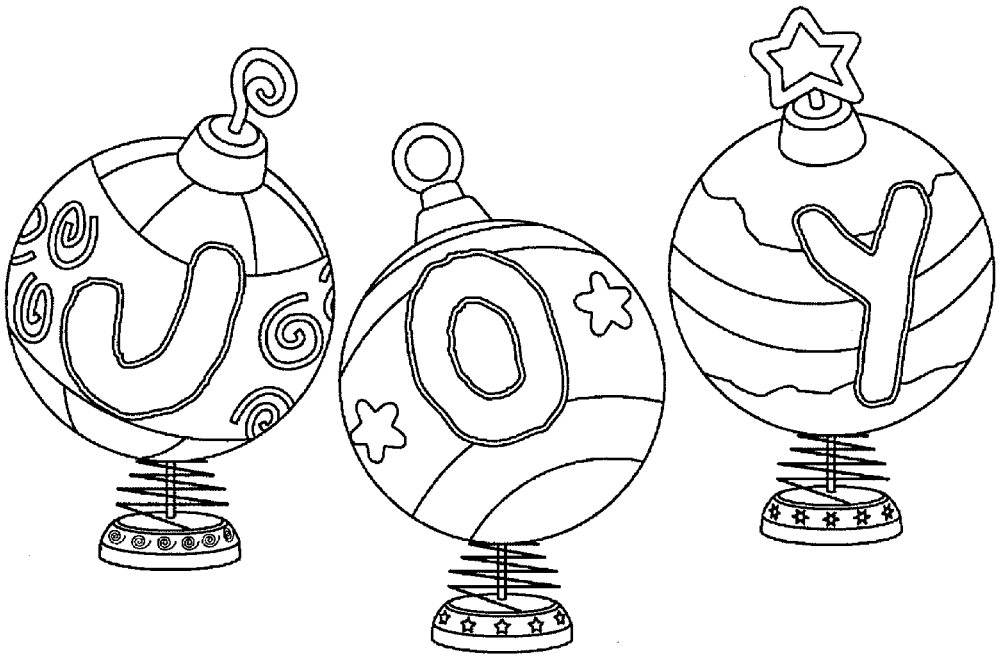
FIG. 6 is a perspective view of a display incorporating the deformable frame as shown in FIG. 5 and further illustrating the display having an exterior sheath surmounting the deformable frame.
Figure 7:
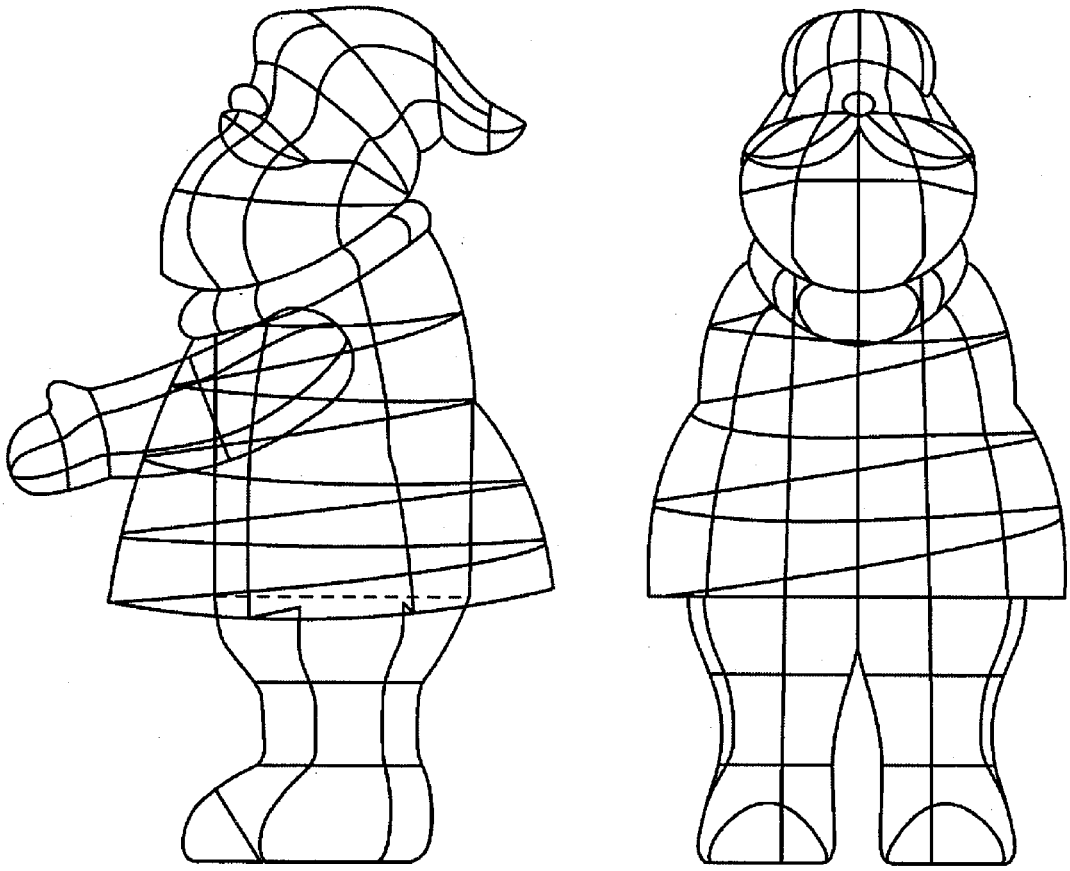
FIG. 7 is a front perspective view of one embodied form of the present invention illustrating the deformable internal frame having a generally contoured configuration incorporating spiral and multiple configurations.
Figure 8:
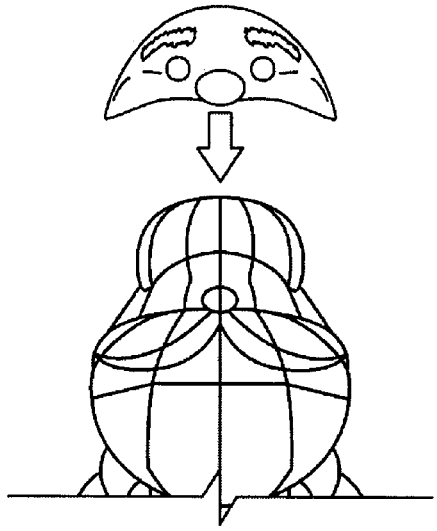
FIG. 8 is a perspective view of a display incorporating the deformable frame as shown in FIG. 7 and further illustrating the display having an exterior sheath surmounting the deformable frame.
Figure 9:
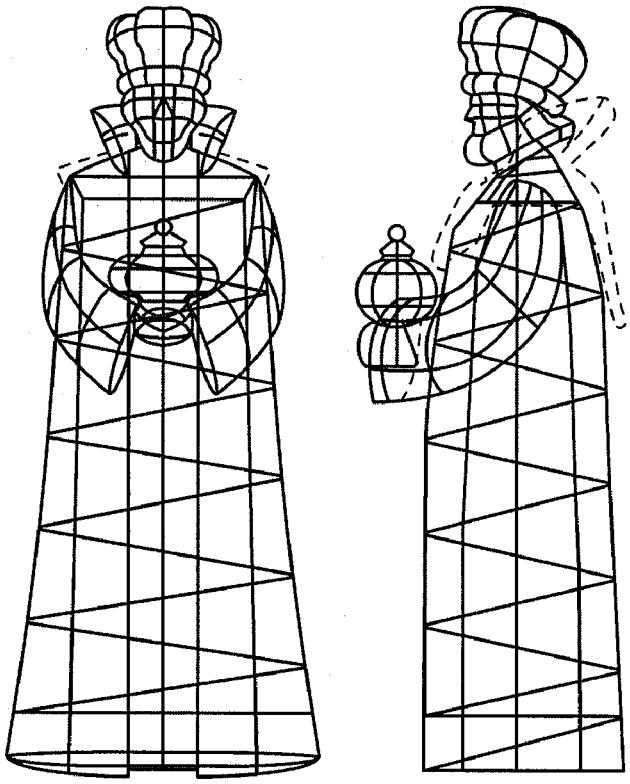
FIG. 9 is a front perspective view of one embodied form of the present invention illustrating the deformable internal frame having a generally contoured configuration incorporating spiral and multiple configurations.
Figure 10:
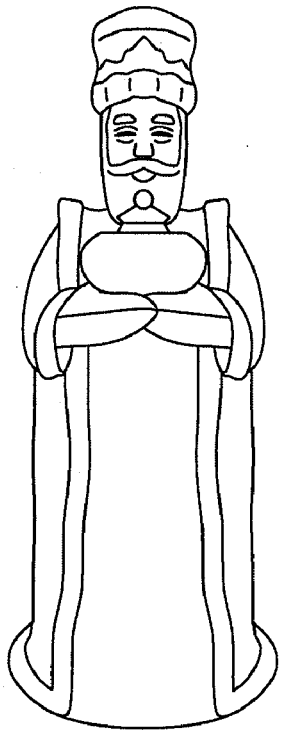
FIG. 10 is a perspective view of a display incorporating the deformable frame as shown in FIG. 9 and further illustrating the display having an exterior sheath surmounting the deformable frame.

FIG. 1 is a front perspective view of one embodied form of the present invention illustrating the deformable internal frame having a generally spiral configuration;

FIG. 2 is a perspective view of a display incorporating the deformable frame as shown in FIG. 1 and further illustrating the display having an exterior sheath surmounting the deformable frame;

FIG. 3 is a front perspective view of one embodied form of the present invention illustrating the deformable internal frame having a generally rectangular shape;

FIG. 4 is a perspective view of a display incorporating the deformable frame as shown in FIG. 3 and further illustrating the display having an exterior sheath surmounting the deformable frame;

FIG. 5 is a front perspective view of one embodied form of the present invention illustrating the deformable internal frame having a generally combination of spiral and circular configurations;

FIG. 6 is a perspective view of a display incorporating the deformable frame as shown in FIG. 5 and further illustrating the display having an exterior sheath surmounting the deformable frame;

FIG. 7 is a front perspective view of one embodied form of the present invention illustrating the deformable internal frame having a generally contoured configuration incorporating spiral and multiple configurations;

FIG. 8 is a perspective view of a display incorporating the deformable frame as shown in FIG. 7 and further illustrating the display having an exterior sheath surmounting the deformable frame;

FIG. 9 is a front perspective view of one embodied form of the present invention illustrating the deformable internal frame having a generally contoured configuration incorporating spiral and multiple configurations; and FIG. 10 is a perspective view of a display incorporating the deformable frame as shown in FIG. 9 and further illustrating the display having an exterior sheath surmounting the deformable frame.

The fabric skin may be composed of nylon and a mixture of spandex, which provides the elasticity and form fitting surmounting the internal frame.

Suitable fabric coverings may come in a variety of fibers and fiber combinations. Commonly used fibers include cotton, wool, nylon, acrylic, polyester, olefin, and spandex. Occasionally, metallic fibers such as mylar coated gold, silver and other reflective metals may be blended for visual effect, but this adds to the cost.

Synthetic fibers, particularly nylon, are strong and make an excellent choice for displays subject to hard wear. Portions of the coverings may also be reinforced at select locations with this durable fiber. Acrylic fibers are also suitable as are Olefin fibers.

The sheath may be knitted, giving the covering stretch and the ability to conform to the internal frame. Generally, a plain knit stitch can be used in the portion of the cover and a rib stitch is used where stretch is needed. The rib stitch is very stretchy, with the ability to return to shape.

The internal frame may be secured to the outer sheath by fasteners such as zipper snaps, clamps, hook and loop-type strips sold under the trademark VELCRO strips or other known means. The fasteners will be designed to mate with and be secured to corresponding receptacles or mating hook and loop-type strips mounted on the cover.

The frame may also be provided with flexible hinges so that it can be folded into a more compact configuration when the display device is disassembled for shipment or storage.

Internal light fixtures for illuminating the assembled display from within the cover may be associated with the internal frame. The light fixtures may include a socket mounted on the frame and electric light strings operating with the socket. Power maybe supplied to the bulb by a conventional power supply using a conventional electrical cord. When power is supplied to the bulb, it attractively and safely illuminates the cover from within. The bulb may be turned on in a conventional fashion by, for example, operating a switch incorporated into the light fixture, or by merely connecting the electrical cord to the power supply.

In other embodiments, the display may include a vibration device coupled to the amusement device to produce vibrational motion of the three dimensional figure. The sheath preferably provides a paintable surface. The sheath may include a molded image having three-dimensional molded details. The three-dimensional details may include at least one of body features, personal effects and appendages. The rubberized sheath provides a flexible body, which holds its shape when released.

Flexible sheath may include a silicon-based rubber, such as, for example, KRATON. In a preferred embodiment, flexible sheath includes an injection moldable silicon based rubber. Other flexible materials may be employed which provide flexibility while maintaining three-dimensional details of the display.

The outer sheath may be composed of formed from a plurality of pieces, which may be combined of a plurality of parts. For example, a head may include a rigid moldable plastic piece such as polyvinyl chloride (PVC) or other rigid plastic material. A rigid head may provide structural support or permit different colors or features. For example, a rigid plastic part maybe carried or attached as shown in various FIGS. 4-10.

The display include a human or animal likeness, a mythical character or superhero or any other famous or infamous character, etc. In preferred embodiments, the display may include a rock star, model, sports figure, cartoon character, a monster, an actor/actress or the like. The display may be dressed up, painted or otherwise detailed in the likeness of a subject character.

Other features may also be added to the display. For example, real or fake hair or a heart may be added to head, or a tool, instrument, sports apparatus, microphone or other apparatus maybe placed in the hand of appendage.

Having described preferred embodiments for my invention (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

These and other objects, features and advantages of the present invention will become apparent from the following detailed description of illustrative embodiments thereof, which is to be read in connection with the accompanying drawings.

I claim:

1. A three-dimensional decorative display device, comprising:

a three-dimensional support-frame structure including an exterior portion and defining a contoured form;

one or more rigid parts attachable to the three-dimensional support-frame structure of the display device;

a plurality of lights attached to the three-dimensional support-frame structure; and a form-fitting sheath surmounting substantially all of the exterior portion of the support-frame structure and the plurality of lights, the sheath comprising an elastic material and defining a shape substantially the same as the contoured form such that the sheath conforms to the support frame structure and is adjacent to substantially all of the exterior portion of the three-dimensional support-frame structure;

wherein the display device defines a three-dimensional display configuration and a disassembled storage configuration, such that in the three-dimensional display configuration, the one or more rigid parts are attached to the frame of the display device, and such that in the disassembled storage configuration, the rigid parts are detached from the display device.

2. The decorative display device of claim 1, wherein the three-dimensional support-frame structure comprises metal wire.

3. The decorative display device of claim 1, wherein the three-dimensional support-frame structure further includes a plurality of interconnected frame members.

4. The decorative display device of claim 1, wherein the three-dimensional support-frame structure comprises a free-standing structure.

5. The decorative display device of claim 1, further comprising a base portion to which the three-dimensional support-frame is attached.

6. The decorative display device of claim 1, wherein the contoured form is selected from the group consisting of a human figure, an animal figure, a holiday ornament, a holiday gift package, and a Christmas tree.

7. The decorative display device of claim 1, wherein the elastic material comprises a fabric material.

8. The decorative device of claim 7, wherein the fabric material comprises a woven fabric or a knitted fabric.

9. The decorative device of claim 7, wherein a portion of the fabric material comprises a rib-stitch for elasticity.

10. The decorative device of claim 7, wherein the fabric material is selected from the group consisting of cotton, nylon, acrylic, polyester, olefin, spandex, and any combination thereof.

11. The decorative display device of claim 1, wherein the elastic material is translucent.

12. The decorative display device of claim 1, wherein the form-fitting sheath comprises a plurality of connected pieces.

13. A lighted three-dimensional decorative display device, comprising:

a frame fabricated from a metallic material, the frame forming a three-dimensional frame structure having an exterior portion and defining a contoured shape;

one or more rigid parts attachable to the frame of the display device;

a lighting string coupled to the three-dimensional frame structure, the lighting string having a plurality of sockets and bulbs; and an elastic fabric sheath constructed in a shape complementary to the contoured shape of the three-dimensional frame structure, the elastic fabric sheath stretched over substantially all of the exterior portion of the three-dimensional frame structure and the lighting string such that the elastic fabric sheath conforms to contours of the support frame structure;

wherein the lighting string illuminates the display device from within a space formed of the frame structure covered by the elastic fabric sheath and the display device defines a three-dimensional display configuration and a disassembled storage configuration, such that in the three-dimensional display configuration, the one or more rigid parts are attached to the frame of the display device, and such that in the disassembled storage configuration, the rigid parts are detached from the display device.

14. The three-dimensional decorative display device of claim 13, wherein the contoured shape is selected from the group consisting of a human figure, an animal figure, a holiday ornament, a holiday gift package, and a Christmas tree.

15. The three-dimensional decorative display device of claim 13, wherein the elastic fabric sheath comprises a translucent material.

16. The three-dimensional decorative display device of claim 13, wherein the flexible fabric sheath includes metallic fibers.

17. The three-dimensional decorative display device of claim 13, wherein the flexible fabric sheath comprises a fabric including plain knit stitching and rib stitching.

18. A three-dimensional decorative device, comprising:

a display device including:

an internal support-frame structure defining a three-dimensional, contoured form and having an exterior portion and an interior portion;

one or more lights attached to the internal support-frame structure and substantially within the interior portion of the internal support-frame structure;

a first flexible form-fitting sheath comprising an elastic material;

one or more rigid parts attachable to the display device; and wherein the display device defines a three-dimensional display configuration and a disassembled storage configuration, such that in the three-dimensional display configuration, the rigid parts are attached to the display device and the sheath in the stretched disposition substantially surmounts all of the exterior portion of the support-frame structure, and such that in the disassembled storage configuration, the rigid parts are detached from the display device.

19. The decorative device of claim 18, wherein the one or more rigid parts are attached to the sheath when the display device is in the three-dimensional display configuration.

20. The decorative device of claim 18, wherein the one or more rigid parts are attached to the internal frame support structure when the display device is in the three-dimensional display configuration.

21. The decorative device of claim 18, wherein the one or more rigid parts are selected from the group consisting of a body feature, a personal effect and an appendage.

22. The decorative device of claim 18, wherein the internal support-frame structure comprises a metal material.

23. The decorative device of claim 18, wherein the elastic material comprises a fabric material.

24. The decorative device of claim 18, wherein the sheath defines a shape, the shape substantially the same as the contoured form of the internal support structure while in a stretched disposition.

* * * * *